United States Patent [19]

Zisterer

[11] 4,302,954

[45] Dec. 1, 1981

[54] LOCK AGAINST THEFT FOR SKIS

[76] Inventor: Peter Zisterer, Schubertstr. 14, D-7209 Gosheim, Fed. Rep. of Germany

[21] Appl. No.: 118,708

[22] Filed: Feb. 5, 1980

[30] Foreign Application Priority Data

May 10, 1979 [DE] Fed. Rep. of Germany ... 7913531[U]

[51] Int. Cl.[3] ..... E05B 67/06; E05B 73/00

[52] U.S. Cl. ..... 70/18; 70/49

[58] Field of Search ..... 70/18, 49, 30, 57, 58; 24/73 SG, 81 SK

[56] References Cited

U.S. PATENT DOCUMENTS 3,590,608 7/1971 Smyth ..... 70/58
3,886,770 6/1975 Smith ..... 70/18
4,075,878 2/1978 Best ..... 70/49
4,185,361 1/1981 Stuart ..... 70/18

FOREIGN PATENT DOCUMENTS 459690 9/1913 France ..... 70/18

*Primary Examiner*—Robert L. Wolfe
*Attorney, Agent, or Firm*—Blanchard, Flynn, Thiel, Boutell & Tanis

[57] ABSTRACT

A ski lock for locking skis against theft and to a stationary object includes an elongate bendable member having the two locking parts of a two-part lock fixed to the opposite ends thereof. The elongate bendable member is a cable with coupling members press fitted at desired locations on the cable and having openings through which the pluglike locking part extends.

9 Claims, 5 Drawing Figures

Fig. 1
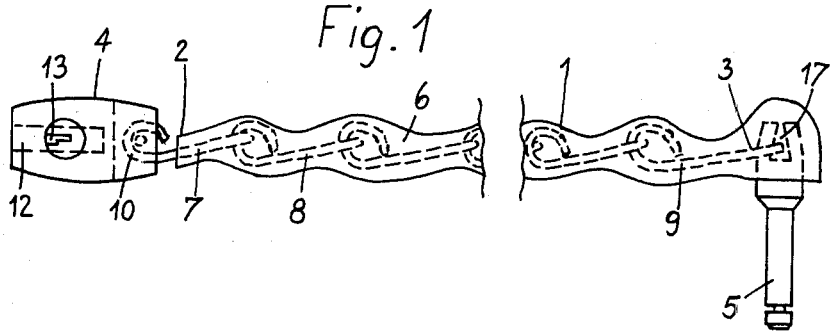
Fig. 2
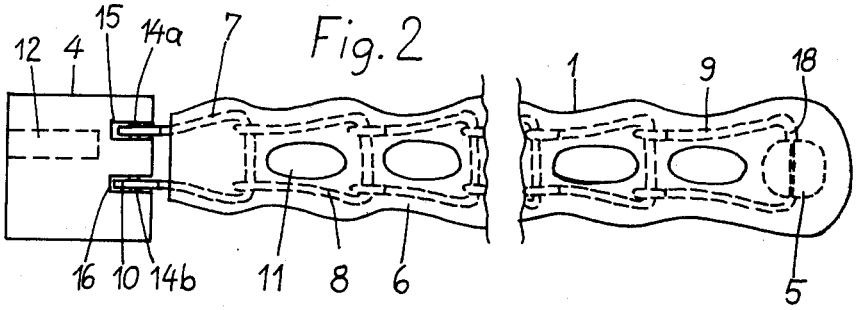
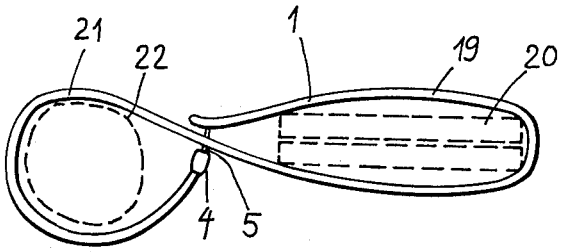
Fig. 3

LOCK AGAINST THEFT FOR SKIS

FIELD OF THE INVENTION

The invention relates to a ski lock to lock skis securely against theft, on a stationary article, for example a car-mounted holder, a post or the like.

BACKGROUND OF THE INVENTION

Skis are often easily releasably secured for example on a carrier, or holder, mounted on a car. Also it is common to lean the skis loosely, for example against a wall of a house, during a break while skiing. This unsecured storing of the skis has resulted, particularly lately, as shown by statistics, in a considerable increase in the theft of skis. Lockable ski holers for cars are already known. Freely standing lockable ski holders, for example at lift stations or guest houses, are also known. These devices are, however, relatively expensive to purchase, and in the case of the stationary lockable ski holders the skier does not find such a ski holder everywhere where he may want to place his skis. To avoid the above disadvantages, with the German Gebrauchsmuster 79 13 531 there has already been provided a ski lock having a flexible longitudinal member, such as a band, rope, wire or rod-shaped design or the like, which has two locking areas which are arranged in longitudinal direction at a greater distance from one another than the perimetral extent of the ski or a pair of skis, which areas can be connected fixedly with one another through a lock which is fixed on the longitudinal member to form a closed loop. However, a higher mechanic solidity of the locking device is desired.

To the above purpose, according to the invention a ski lock is provided wherein said bendable longitudinal member is a bendable locking member to which a lock is allotted to which the one end of the locking member is secured permanently and in which the free end of the bendable locking member can be selectively locked, said bendable locking member having at least one through-receiving means at a distance from its free end, which distance is set to accommodate the perimeter of a ski or a pair of skis, the free end of the bendable locking member being introduceable through said receiving means into the lock to impart to the bendable locking member the shape of a double loop, said receiving means being constructed as a coupling member which is mounted fixedly on the bendable locking member, which in turn passes through said coupling member.

This ski lock embodiment provides an especially high mechanic solidity at low manufacturing cost. It can also well withstand rough forces, as are often used during a theft attempt. In this embodiment, a coupling member can be arranged directly in the vicinity of the lock. This ski lock has thus in operation very compact dimensions. Furthermore the bendable locking member thereof extends substantially without any bends through the coupling member. Moreover, during manufacture, different widths of skis can be provided for by spacing the coupling members correspondingly differently along the bendable locking member and by then fixing them in the desired position by compressing the coupling member at a recess therein through which the bendable locking member extends. Such ski lock can be used universally for a plurality of types of skis. The coupling member remains at all times in close vicinity of the lock, since it is held back by the radial collar. On the one hand, this makes handling of the ski lock easier. On the other hand, it is advantageous in particular for locking skis on roof mounted baggage holders, since the locking member is secured safely and rattle-free in this manner. When the lock is closed, the two loops of the locking member lie substantially in two planes which extend generally perpendicularly to one another. This again is very advantageous when used with a roof mounted baggage carrier, in which the carrier crossbars also extend perpendicularly to the longitudinal direction of the skis.

BRIEF DESCRIPTION OF THE DRAWINGS

The invention will be discussed in more detail hereinafter in connection with an exemplary embodiment and reference to the enclosed drawings, in which:

FIG. 1 is a fragmentary side view of a ski lock with a chain as a longitudinal member.

FIG. 2 is the top view of the ski lock of FIG. 1.

FIG. 3 shows the ski lock of FIGS. 1 and 2 in position for locking a pair of skis to a post.

DETAILED DESCRIPTION

Figure 4:
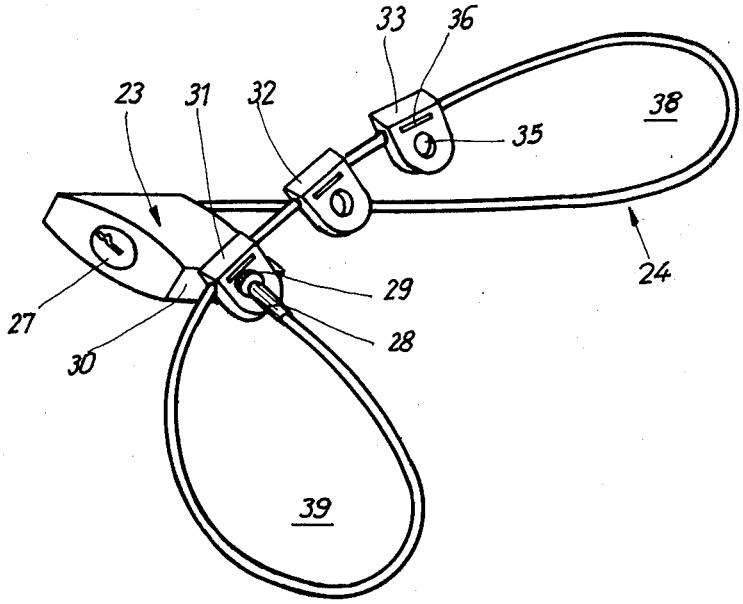
FIG. 4 is a perspective view of a ski lock according to the invention in closed condition.

The ski lock illustrated in FIGS. 1, 2 and 3 permits secure fastening of skis on a stationary object, for example on a car ski holder, a post or the like. Such ski lock includes a bendable longitudinal member 1, such as a band, rope, wire or rod-shaped member or the like. In the illustrated exemplary embodiment the longitudinal member 1 comprises a chain. Such longitudinal member 1 has two locking areas longitudinally spaced from one another by a distance exceeding the perimeter of a ski or a pair of skis. Such locking areas are located at the ends 2 and 3 of the longitudinal member 1 and can be connected fixedly to one another through a lock which is fixed to the longitudinal member 1 for forming a closed loop. Such lock is constructed in two parts, namely locking parts 4 and 5 fixedly connected to the respective ends 2 and 3 of the longitudinal member 1. The longitudinal member 1 has furthermore a plasitc coating 6, cast around the chain which forms the core of the longitudinal member 1. Said coating, or sleeve, 6 protects the chain against corrosion and the skis to be locked against damage. Furhermore, it lends the ski lock a pleasant appearance.

The individual chain links 7, 8 and 9 have, viewed from the top, approximately a U-shaped configuration, wherein the free ends of the U-shapes are bent into eyelets 10 which are directed at a right angle with respect to the longitudinal direction of the chain. The eyelets 10 of each of the intermediate chain links 8 are looped around the crossbar of the respectively adjacent chain link. Thus one obtains, over the length of the longitudinal member 1, a row of openings 11. The openings 11 are spaced at regular intervals, are formed by the chain links and have their inside diameters slightly reduced by the plastic sleeve 6. The diameter of the openings 11 is, however, larger than the diameter of the locking part 5, which is constructed as a plug and has a peglike configuration. With this pluglike locking part 5 is associated a plug opening, or socket, 12 on the other locking part 4, the latter serving as the receiving part. Thus one can plug the locking part 5 directly into the plug opening 12 of the other locking part 4 and lock it with the help of a key which is introduced into a keyhole 13 in locking part 4, which forms a loop with the largest possible diameter. However, one can instead place the locking part 5 first through any opening 11, bend the projecting area of the longitudinal member 1 into a loop, and then fixedly connect the plug part 5 to the other locking part 4. In this manner the longitudinal member is formed into a double loop, or figure-8 shape, the two component loops of which have selectable diameters. Thus one can adapt to the cross section of the skis to be locked or to the cross section, for example of a post, to which the skis are supposed to be secured.

The mentioned U-shaped configuration of the individual chain links brings about not only the formation of the openings 11 but also a simple fastening of the chain to the two locking parts 4 and 5. More particularly, as can be seen from FIGS. 1 and 2, the locking part 4 has a shaft, or axis, 14*a*, 14*b* surrounded and pivotally gripped by the eyelets 10 of the outermost chain link 7. This suffices to fasten the locking part 4 to the outermost chain link. The eyelets 10 of link 7 are each advantageously received in a slot 15 or 16 in the locking part 4, so that the eyelets 10 are recessed.

Fastening of the locking part 5 occurs in a similarly simple manner. Peglike locking part 5 has at one end portion a recess, or gap, 17 through which the crossbar 18 of the other outermost chain link 9 extends. Gap 17 is tapered outwardly to a gap width smaller than the diameter of the crossbar 18 of the U-shaped link 9. In this way the crossbar 18 is secured against falling out of gap 17. Tapering of the gap 17 is achieved by pressing together with a suitable tool, the areas of the locking part 5 flanking the gap, after placing of the crossbar 18 within gap 17.

The connection between the outermost chain member 9 and the pluglike locking part 5 is such that the latter projects substantially at a right angle from the longitudinal member 1.

FIGS. 3 illustrates the longitudinal member 1 only schematically. However, it will be recognized that the locking part 5, which projects rectangularly from the longitudinal member 1, is placed through any desired one of the openings 11 in the longitudinal member and fixedly engages the other locking part 4. The longitudinal member 1 as thus illustrated forms a double loop, wherein the one loop 19 serves to receive the pair of skis 20 and the other loop 21 is lopped around a post 22. Since one can insert the locking part 5 through each of the openings 11, the diameter of each loop is variable.

However, this known ski lock presents some disadvantages, especially as regards its mechanic solidity. Therefore and for purposes of remedy the invention provides the ski lock accordes to FIGS. 4 and 5.

Figure 5:
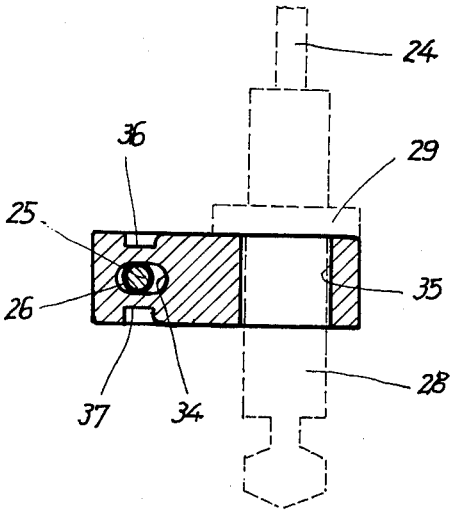
FIG. 5 is a longitudinal cross-sectional view of a coupling member carried by the locking member of the lock of FIG. 4, wherein a locking peg, which is connected to the free end of the locking member, is illustrated in dashed lines.

The ski lock shown in FIG. 4 includes a lock 23 and a bendable locking member 24 in the form of a steel cable with a continuous plastic sleeve 26.

One end of the locking member 24 is permanently fixed in the bottom surface of the lock 23, which surface is opposite the lock cylinder 27. The free end of the locking member 24 carries a locking peg 28 with a radially projecting collar 29. The locking peg 28 can be introduced into a locking opening in the side surface 30 of the lock 23, which side surface 30 lies in front on the right in FIG. 4, and can be locked there. The side surface 30 extends vertically from the bottom surface of the lock 23, in which the firstmentioned end of the locking member 24 is permanently secured.

Three coupling members 31, 32 and 33 are fixedly mounted by press fit one behind the other on the locking member 24. They each have a bore-shaped recess 34 through which the locking member 24 longitudinally extends, and a through-borelike receiving means 35 which is substantially perpendicular to bore 34. The locking peg 28 can be placed through the receiving means with clearance until its collar 29, which has a larger diameter than the receiving means 35, hits the upper side of the respective coupling member 31, 32 or 33.

The coupling members 31, 32, 33 are each mounted on the locking member 24 by first moving the bore 34, which is dimensioned originally to a small clearance, onto the locking member 24 and are then fixed in the desired position by using a suitable pressing tool. The pressing tool creates indentations 36 and 37 in the surfaces of the coupling members.

The distance of the coupling members 31, 32, 33 from the free end of the locking member 24 is adjusted to encircle a ski or pair of skis to be locked. If three coupling members are used, then for example the distance of the coupling member 31 from the locking peg 28 preferably corresponds approximately to the perimeter of a pair of cross-country skis, the distance of the coupling member 32 from the locking peg 28 preferably corresponds approximately to the perimeter of a pair of compact skis and the distance of the coupling member 33 from the locking peg 28 preferably corresponds approximately to the circumference of a normal pair of skis. In this manner the inventive ski lock can be used to lock all common types of skis against theft.

To lock a pair of skis and the associated poles, the free end of the locking member 24 is pulled through the loops on the handles of the poles and is then guided around the pair of skis and is placed through the suitable coupling member 31, 32 or 33. The lock 23 is guided around a stationary post or the like, which in not shown in FIG. 4. The locking peg 28 is then introduced into the lock 23 and is locked there. The locking member 24 thus forms, as shown in FIG. 4, two loops 38 and 39, one to receive the pair of skis and the loops of the poles and the other to receive the stationary post. The two loops 38 and 39 lie in the nonloaded condition in two planes which are substantially perpendicular to one another. The locking member 24 runs practically without bending through the coupling member which is secured through the locking peg 28 on the lock 23, since the latter can freely rotate around the longitudinal axis of the locking peg 28. For this the distance of the collar 29 from the side surface 30 is chosen slightly larger than the thickness of one coupling member when the locking peg 20 is in engagement.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski lock for locking of skis against theft to a stationary object, for example on a car ski holder, a post or the like, comprising a bendable longitudinal member, which has two locking areas longitudinally spaced from one another by a distance exceeding the perimeter of a ski or a pair of skis, which locking area can be connected fixedly to one another for forming a closed loop through a lock mounted on the longitudinal member, wherein said bendable longitudinal member is a bendable locking member to which a lock is allotted to which the one end of the locking member is secured permanently and in which the free end of the bendable locking member can be selectively locked, said bendable locking member having at least one through-receiving means at a distance from its free end, which distance is set to accommodate the perimeter of a ski or a pair of skis, the free end of the bendable locking member being introduceable through said receiving means into the lock to impart to the bendable locking member the shape of a double loop, said receiving means being constructed as a coupling member which is mounted fixedly on the bendable locking member, which in turn passes through said coupling member.

2. A ski lock according to claim 1, wherein each coupling member has a recess for receiving the bendable locking member, the axis of which recess is positioned at right angles to the axis of the through-receiving means.

3. A ski lock according to claim 2, wherein the coupling members are moved onto the bendable locking member and are then clamped on same through a permanent deformation of the coupling members.

4. A ski lock according to claim 3, wherein the coupling members are pressed from oppositely positioned front surfaces adjacent the recess.

5. A ski lock according to claim 1, wherein the bendable locking member comprises a steel cable.

6. A ski lock according to claim 5, wherein said steel cable is provided with a plastic sleeve.

7. A ski lock according to claim 1, including a plurality of said coupling members mounted in longitudinally spaced relation on the bendable locking member, the distance of respective said coupling members from the free end of the locking member being adjusted to the perimetral distance of various types of skis.

8. A ski lock according to claim 1, wherein the free end of the bendable locking member has a radial collar, the diameter of which is larger than the diameter of the said through-receiving means.

9. A ski lock according to claim 1, wherein the free end of the locking member is engageable fixedly in one side surface of the many-sided lock, which defines an angle of approximately 90° with the side surface in which the other end of the locking member is permanently fixed.

* * * * *